US007399166B2

(12) United States Patent
Uchino et al.

(10) Patent No.: US 7,399,166 B2
(45) Date of Patent: Jul. 15, 2008

(54) VARIABLE DISPLACEMENT PUMP

(75) Inventors: Kazuyoshi Uchino, Saitama (JP); Shigeyuki Miyazawa, Saitama (JP)

(73) Assignee: Unisia JKC Steering Systems Co., Ltd., Kanagawa (JP)

( * ) Notice: Subject to any disclaimer, the term of this patent is extended or adjusted under 35 U.S.C. 154(b) by 588 days.

(21) Appl. No.: 10/890,243

(22) Filed: Jul. 14, 2004

(65) Prior Publication Data

US 2005/0019175 A1 Jan. 27, 2005

(30) Foreign Application Priority Data

Jul. 25, 2003 (JP) ..... 2003-279866

(51) Int. Cl.
*F04B 49/00* (2006.01)
*F04B 1/06* (2006.01)

(52) U.S. Cl. ..... 417/220; 417/219

(58) Field of Classification Search ..... 417/220, 417/219; 418/29, 30, 31
See application file for complete search history.

(56) References Cited

U.S. PATENT DOCUMENTS

| | | | | |
|---|---|---|---|---|
| 5,538,400 | A * | 7/1996 | Konishi et al. | 417/220 |
| 5,895,209 | A | 4/1999 | Miyazawa | |
| 6,155,797 | A | 12/2000 | Kazuyoshi | |
| 6,217,296 | B1 * | 4/2001 | Miyazawa et al. | 417/310 |
| 6,524,076 | B2 | 2/2003 | Konishi | |
| 6,619,928 | B2 | 9/2003 | Konishi | |
| 6,736,604 | B2 | 5/2004 | Okada | |
| 6,976,830 | B2 * | 12/2005 | Uchino | 417/220 |
| 2001/0036412 | A1 * | 11/2001 | Konishi | 417/220 |

FOREIGN PATENT DOCUMENTS

| | | | |
|---|---|---|---|
| DE | 101 61 296 | A1 | 9/2002 |
| DE | 102 27 149 | A1 | 1/2003 |
| DE | 10240409 | A1 * | 3/2003 |
| JP | 09-273487 | A | 10/1997 |
| JP | 2000-087877 | A | 3/2000 |
| JP | 2003-074479 | A | 3/2003 |
| KR | 0201995 | B1 | 6/1999 |

OTHER PUBLICATIONS

U.S. Appl. No. 10/889,126, filed Jul. 13, 2004, Uchino et al.

* cited by examiner

*Primary Examiner*—Devon Kramer
*Assistant Examiner*—Jessica L Frantz
(74) *Attorney, Agent, or Firm*—Foley & Lardner LLP

(57) ABSTRACT

A variable displacement pump includes a control valve formed with a high-pressure chamber for introducing therein high-pressure fluid on the upstream side of a metering orifice, a pressure chamber for introducing therein pressure fluid on the downstream side of the metering orifice, a low-pressure chamber arranged between the high-pressure and pressure chambers for introducing therein low-pressure fluid, and a communication passage for providing fluid communication between one of the high-pressure and low-pressure chambers and a first fluid-pressure chamber of the pump. First and second recessed grooves are formed in the outer-peripheral surface of a spool of the control valve to provide fluid communication between the low-pressure and high-pressure chambers through the communication passage of the control valve when the spool carries out selective switching between the high-pressure and low-pressure chambers to supply fluid to the communication passage, thus restraining abrupt pressure rise in the first fluid-pressure chamber.

11 Claims, 4 Drawing Sheets

VARIABLE DISPLACEMENT PUMP

BACKGROUND OF THE INVENTION

The present invention relates to a variable displacement pump which serves as a source for supplying the hydraulic pressure to a hydraulic device such as an automotive power steering apparatus.

Typically, the variable displacement pump comprises a housing, a cam ring arranged swingably in the housing, first and second fluid-pressure chambers arranged in one and another swing directions of the cam ring, respectively, and a spring arranged in the second fluid-pressure chamber and for biasing the cam ring to the first fluid-pressure chamber.

Arranged rotatably in the cam ring is a vane rotor having an axis offset with respect to the center of the cam ring. The vane rotor comprises slots formed radially in the outer periphery and vanes held therein to be movable with respect to the inner-peripheral surface of the cam ring.

A metering orifice is provided to a discharge passage for supplying to a hydraulic device pressurized fluid discharged from a pump chamber formed between the cam ring and each vane to a discharge port. A control valve comprises a spool arranged slidably in a valve hole by the pressure difference between the upstream and downstream sides of the metering orifice. The fluid pressure within the first fluid-pressure chamber is controlled in accordance with the slide position of the spool.

Specifically, the control valve comprises a high-pressure chamber formed at one end of the spool and for introducing pressurized fluid on the upstream side of the metering orifice, a pressure chamber formed at another end of the spool and for introducing pressurized fluid on the suction side of the pump, and a low-pressure chamber comprising an annular groove formed substantially in the center of the outer-peripheral surface of the spool and for introducing pressurized fluid in a tank. The control valve controls internal pressure such that, in accordance with slide motion of the spool to the pressure chamber, a cylindrical valve element formed on the outer periphery of the spool carries out selective switching from the low-pressure chamber to the high-pressure chamber so as to supply fluid in the high-pressure chamber to the first fluid-pressure chamber.

The second fluid-pressure chamber is isolated from the control valve to always introduce therein pressure from the suction side of the pump.

Therefore, during low rotation of the pump, the control valve is not operated due to small pressure difference between the upstream and downstream sides of the metering orifice, so that the first fluid-pressure chamber is supplied with low-pressure (atmospheric-pressure) fluid in the tank. Thus, the cam ring is biased to the first fluid-pressure chamber by a biasing force of the spring arranged in the second fluid-pressure chamber, having center offset with respect to the center of the vane rotor. This increases volume of the pump chambers formed between the vanes and the cam ring and on the side of the second fluid-pressure chamber, allowing the power steering apparatus to be supplied with sufficient flow rate of pressurized fluid through the discharge port and the discharge passage.

As the pump is in high rotation, the spool of the control valve is operated to the pressure chamber due to great pressure difference between the upstream and downstream sides of the metering orifice, so that the valve element of the control valve is moved to carry out switching from the low-pressure (tank-pressure) chamber to the high-pressure chamber. Thus, highly pressurized fluid discharged to the discharge port is supplied to the first fluid-pressure chamber so as to swing the cam ring to the second fluid-pressure chamber against a biasing force of the spring, controlling the volume of the pump chambers at a small value. With this, the power steering apparatus is supplied with a predetermined flow rate of pressurized fluid, ensuring constant flow rate thereof.

During low rotation of the pump where it is desirable to ensure the pump discharge, only the fluid pressure within the low-pressure chamber operates on the second fluid-pressure chamber as described above, so that leakage of pressurized fluid from the second fluid-pressure chamber to the outside is prevented from occurring, allowing the pump discharge to be ensured sufficiently.

SUMMARY OF THE INVENTION

With the above typical variable displacement pump, however, when pump rotation passes from low to high rotation to slide the spool of the control valve from the high-pressure chamber to the pressure chamber, the valve element carries out in an on-off way switching from the low-pressure chamber to the high-pressure chamber for fluid communication with the first fluid-pressure chamber. That is, with movement of the valve element, the first fluid-pressure chamber is abruptly switched from communicating with the low-pressure chamber during pump low rotation to communicating with the high-pressure chamber.

Thus, the pressure within the first fluid-pressure chamber is abruptly changed from the low pressure to the high pressure, causing oscillation of the cam ring in the swing direction, leading to possible unstableness of the flow rate of pressurized fluid discharged from the pump up to sufficient buildup of the pressure within the first fluid-pressure chamber. Moreover, oscillation of the cam ring can produce noises.

It is, therefore, an object of the present invention to provide a variable displacement pump which allows stable flow rate of pressurized fluid discharged from the pump with occurrence of noises restrained.

The present invention provides generally a variable displacement pump, which comprises: a housing; a cam ring arranged in the housing, the cam ring being swingable in the housing; a seal member provided in a chamber formed between the housing and the cam ring, the seal member dividing the chamber into two portions that defines first and second fluid-pressure chambers; a rotor rotating within the cam ring within the cam ring and formed with slits, the rotor having an axis offset with respect to an axis of the cam ring; a plurality of vanes inserted retractably into the slits; a biasing device arranged in the second fluid-pressure chamber, the biasing device biasing the cam ring to the first fluid-pressure chamber in the direction that increases volumes of pump chambers defined between the cam ring, the rotor, and the vanes; an orifice provided to a discharge passage, the discharge passage supplying to a hydraulic device a fluid discharged from a discharge port; a control valve operated by a pressure difference between upstream and downstream sides of the orifice, the control valve comprising a spool slidably arranged in a valve hole, the control valve controlling in accordance with a slide position of the spool at least one of pressures within the first and second fluid-pressure chambers to oscillate the cam ring for variable control of a flow rate of the fluid, the control valve being formed with a high-pressure chamber for introducing therein a high-pressure fluid on the upstream side of the orifice, a pressure chamber for introducing therein a pressure fluid on the downstream side of the orifice, a low-pressure chamber arranged between the high-pressure and pressure chambers for introducing therein a low-pressure fluid, and a communication passage for providing fluid communication between one of the high-pressure and low-pressure chambers and the first fluid-pressure chamber; and a communication device which provides fluid communication between the low-pressure and high-pressure chambers through the communication passage of the control valve when the spool carries out selective switching between the high-pressure and low-pressure chambers to supply the fluid to the communication passage.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
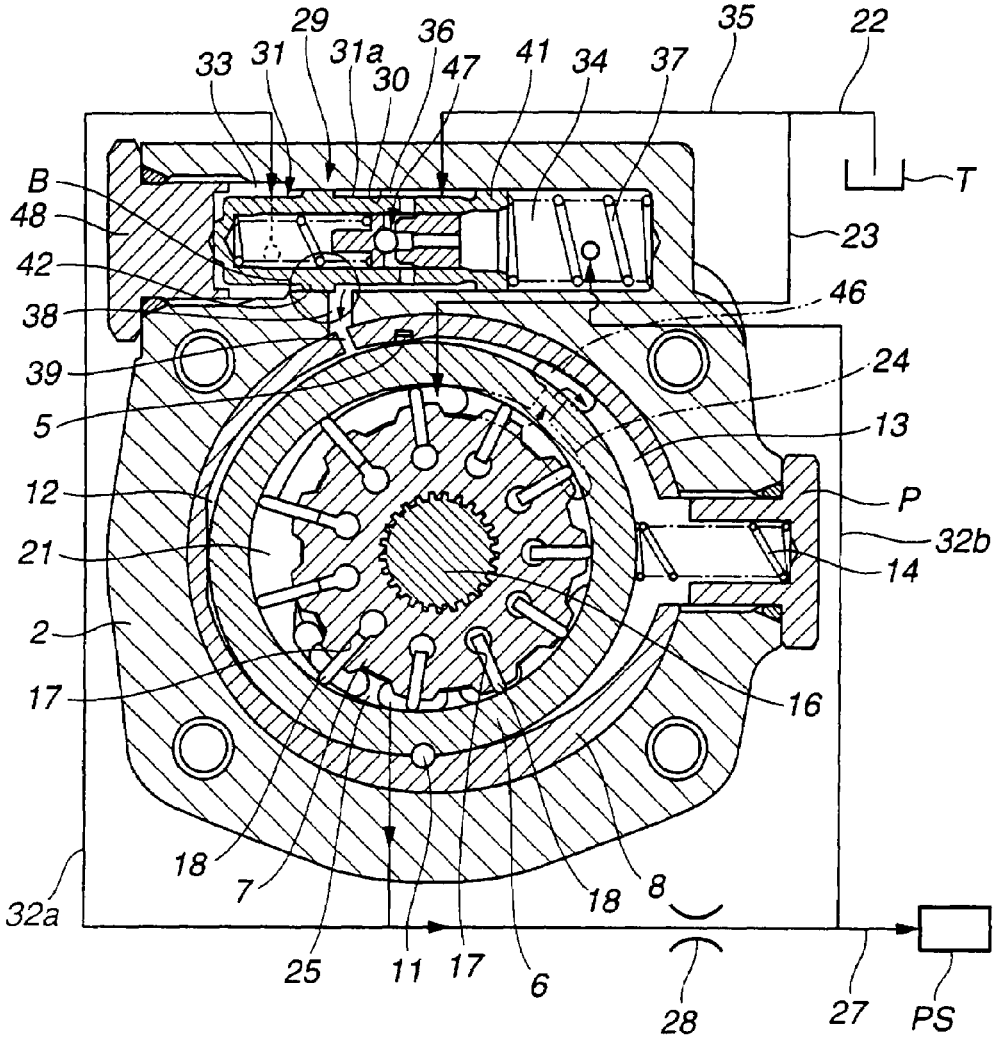
FIG. 1 is a sectional view taken along the line 1-1 in FIG. 2.

Referring to the drawings, a description is made about a preferred embodiment of a variable displacement pump according to the present invention.

Figure 2:
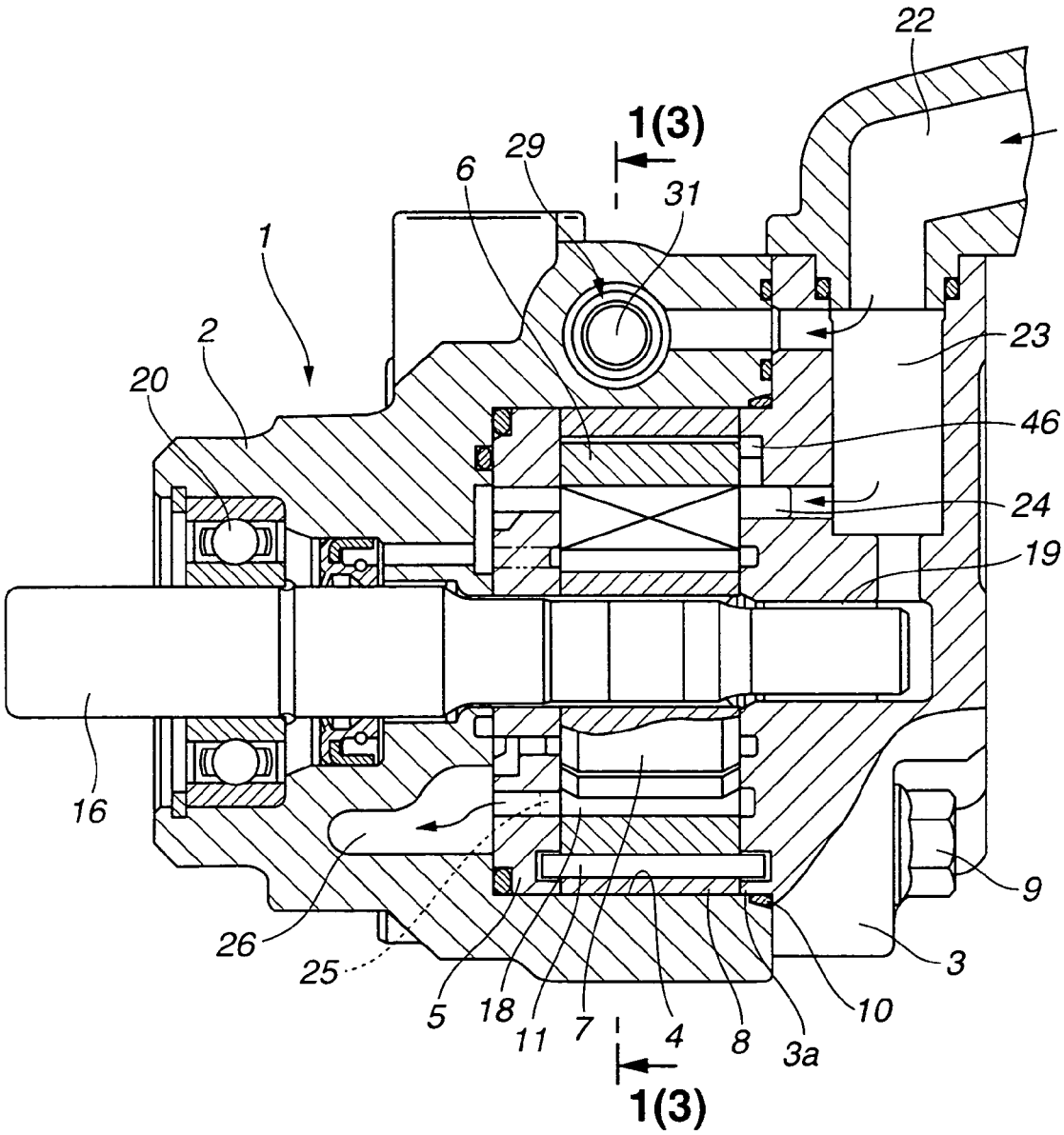
FIG. 2 is a longitudinal sectional view showing an embodiment of a variable displacement pump according to the present invention.

Referring to FIG. 2, the variable displacement pump serves as a source for supplying the hydraulic pressure to a hydraulic device such as a power steering apparatus, and comprises a pump body 1 including a cup-shaped front body 2 located at the left as viewed in FIG. 2 and a rear body 3 located at the right as viewed in FIG. 2.

Front body 2 is formed with a concave 4 at an end on the side of rear body 3, in which pump component members such as a pressure plate 5, a cam ring 6, a vane rotor 7, and an adaptor ring 8 are accommodated. With an annular protrusion 3*a* of rear body 3 engaged in an open end of concave 4, front body 2 is coupled to rear body 3 by a bolt 9. An annular seal member 10 is interposed between the open end of concave 4 and annular protrusion 3*a* to seal the inside of concave 4.

Pressure plate 5 is arranged on the bottom of concave 4, whereas adaptor ring 8 is arranged on the outer side face of pressure plate 5 in a close contact way, inside of which cam ring 6 and vane rotor 7 are accommodated.

Referring to FIG. 1, cam ring 6 is swingably arranged in adaptor ring 8 with a seal pin 11 provided to a lower inner-peripheral portion of adaptor ring 8 as an oscillating fulcrum, increasing and decreasing the pump volume through such swing motion. Moreover, cam ring 6 cooperates with the inner-peripheral surface of adaptor ring 8 to define first and second fluid-pressure chambers 12, 13 on both sides of the outer-peripheral surface in the swing direction of cam ring 6.

Cam ring 6 is biased in the direction of first fluid-pressure chamber 12 by a compression coil spring or biasing means 14 having one end supported resiliently by a plug P screwed in a side of front body 2 on the side of second fluid-pressure chamber 13. Moreover, cam ring 6 is reciprocatively swung by the relative pressure between pressurized fluid supplied from a control valve 29 as will be described later to first fluid-pressure chamber 12, and pressurized (tank-pressure) fluid supplied to second fluid-pressure chamber 13 and biasing pressure of compression coil spring 14.

First and second fluid-pressure chambers 12, 13 are shaped roughly like a crescent, and are fluid-tightly sealed together by seal pin 11 and a seal member 15 arranged opposite to seal pin 11, i.e. roughly 180° away therefrom.

Referring to FIGS. 1 and 2, vane rotor 7 is rotatably accommodated inside cam ring 6, and is coupled through a central fixing hole to a driving shaft 16 arranged through front body 2. Vane rotor 7 comprises slots 17 formed radially in the outer periphery and vanes 18 of thin plate held therein to be movable with respect to the inner-peripheral surface of cam ring 6. Driving shaft 16 is driven by an engine, not shown, through a timing belt and the like, and has a front end supported by a plain bearing 19 held in rear body 3 and a base end supported by a ball bearing 20 held in front body 2.

As shown in FIG. 1, working fluid accumulated in a tank T is sucked into pump chambers 21 formed between the inner-peripheral surface of cam ring 6 and vanes 18 through a suction pipe 22 fixed to rear body 3 and suction passage 23 and a suction port 24 formed in rear body 3.

Working fluid sucked into pump chambers 21 is discharged to a discharge-pressure chamber 26 formed in the bottom of front body 2 through a discharge port 25 formed in pressure plate 5, which is then supplied to a power steering apparatus PS through a discharge passage 27. A metering orifice 28 is provided to discharge passage 27.

As shown in FIG. 1, control valve 29 comprises principally a cylindrical valve hole 30 formed in an upper portion of front body 2 and spool 31 arranged axially slidably in valve hole 30.

A high-pressure chamber 33 is formed between valve hole 30 and a front end of spool 31 to introduce therein pressurized fluid on the upstream side of metering orifice 28 of discharge passage 27 through a first pressure passage 32*a*. A pressure chamber 34 is formed between valve hole 30 and a rear end of spool 31 to introduce therein pressurized fluid on the downstream side of metering orifice 28 through a second pressure passage 32*b*. And a low-pressure chamber 36 is formed between the inner-peripheral surface of valve hole 30 and a cylindrical annular groove 31*a* formed substantially in the center of the outer-peripheral surface of spool 31 to introduce therein working fluid in tank T through a low-pressure passage 35.

Valve hole 30 has an end opening on the side of high-pressure chamber 33, which is closed by a plug 48, and communicates with first fluid-pressure chamber 12 through a communication passage 38 having one end 38*a* which opens substantially in the center of valve hole 30 and a passage hole 39 formed radially through adaptor ring 8.

Spool 31 is biased to high-pressure chamber 33 by a biasing force of a coil spring 37 supported resiliently in pressure chamber 34. Spool 31 comprises a land 41 formed on the rear-end outer periphery to isolate pressure chamber 34 and low-pressure chamber 36, and a valve element 42 integrally formed substantially in the center of the outer-peripheral surface to carry out selective switching between low-pressure chamber 36 and high-pressure chamber 33 for fluid communication with communication passage 38 in accordance with slide motion of spool 31.

Figure 3:
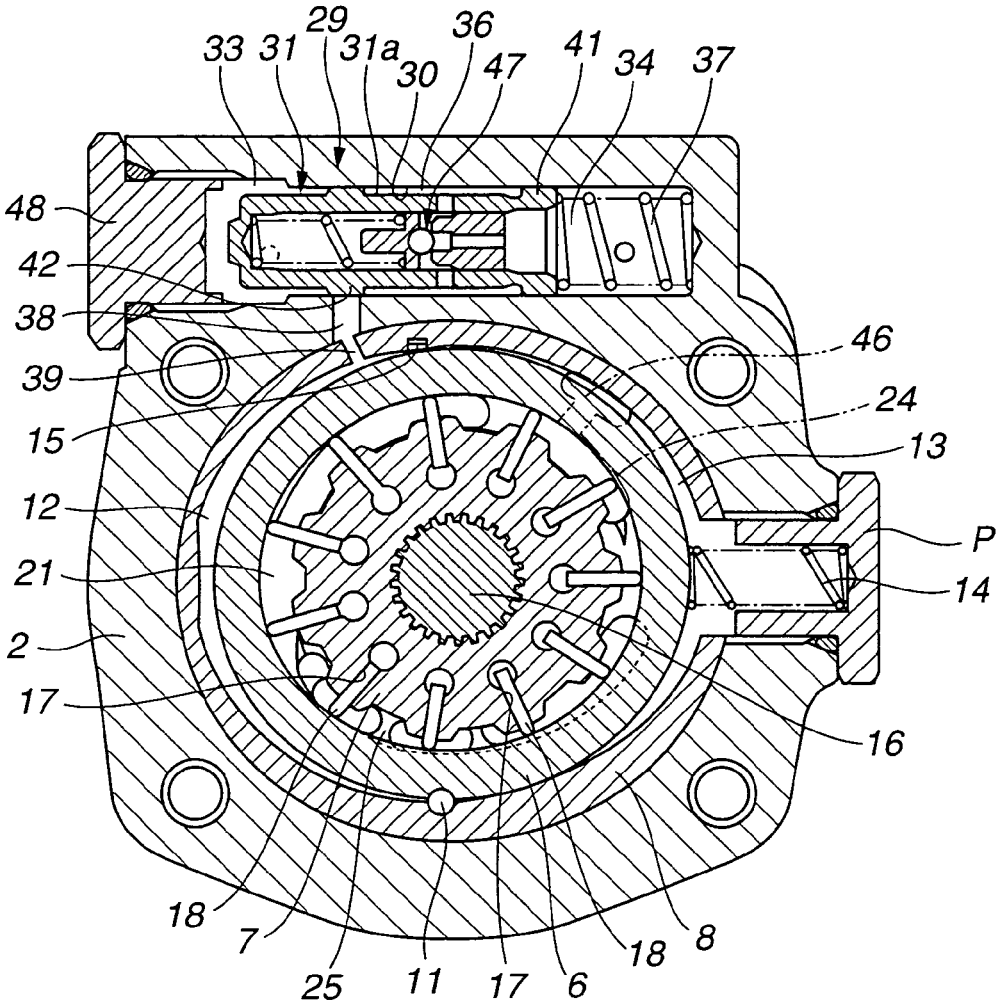
FIG. 3 is a view similar to FIG. 1, taken along the line 3-3 in FIG. 2 and for explaining operation of the embodiment.

Specifically, referring to FIGS. 1 and 3, valve element 42 is shaped annularly, and is configured such that, in accordance with slide motion of spool 31 by the pressure difference between high-pressure chamber 33 and pressure chamber 34, open end 38*a* of communication passage 38 on the side of valve hole 30 is switched to communicate with low-pressure chamber 36 or high-pressure chamber 33.

Figure 4:
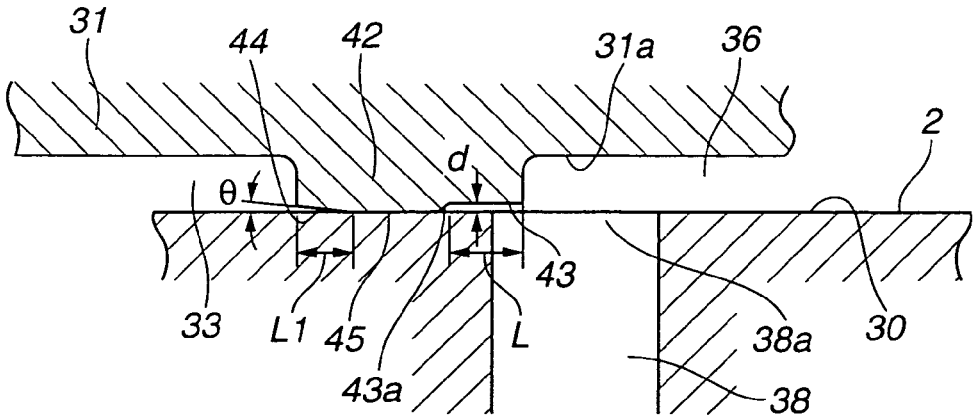
FIG. 4 is an enlarged sectional view showing a portion B in FIG. 1.
Figure 5:
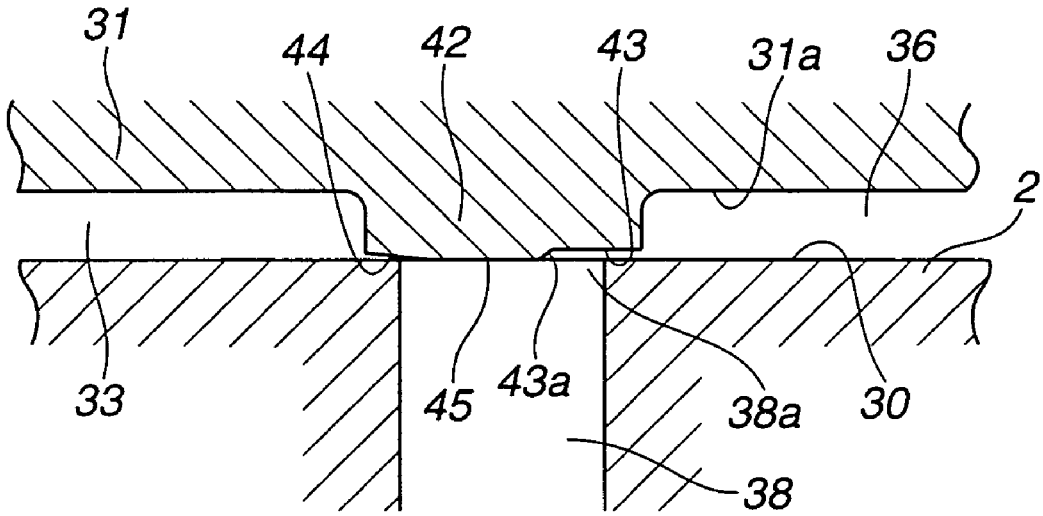
FIG. 5 is a view similar to FIG. 4, showing the portion B and for explaining operation of a valve element.
Figure 6:
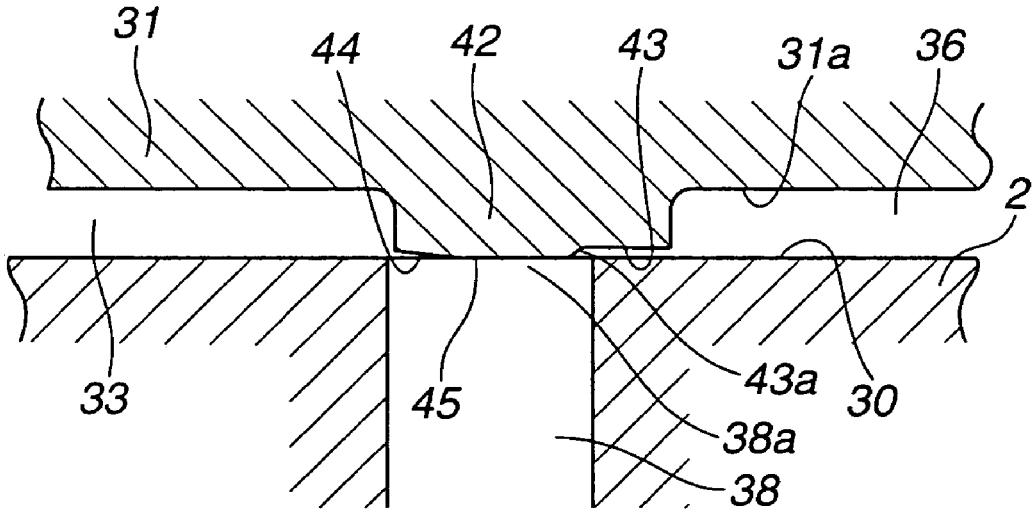
FIG. 6 is a view similar to FIG. 5, showing the portion B and for explaining operation of the valve element.

Referring to FIGS. 4-6, the outer-peripheral surface of valve element 42 has a first recessed groove 43 formed at an end on the side of low-pressure chamber 36, and a second recessed groove 44 formed at an end on the side of high-pressure chamber 33. A second land 45 is formed between first and second recessed grooves 43, 44.

First recessed groove 43 is shaped annularly, and has an axial length L set relatively great to extend up to substantially the axial center of valve element 42 and a depth "d" set fairly small. A stepped inner edge 43*a* on the side of second land 45 is shaped roughly like a smooth circular arc.

Second recessed groove 44 is shaped in a taper way to gradually be larger from the side of second land 45 to the side of high-pressure chamber 33, and has a length L1 set smaller than length L of fist recessed groove 43 and a taper angle θ set fairly small, i.e. at several degrees.

Second land 45 has an axial length set relatively small, and shuts off fluid communication between first and second recessed grooves 43, 44 with the outer-peripheral surface abutting on the inner-peripheral surface of valve hole 30.

Second fluid-pressure chamber 13 is configured to always introduce therein low-pressure working fluid in tank T through suction passage 23, suction port 24, and a communication groove 46 formed in the inner end face of rear body 3.

Arranged in spool 31 is a relief valve 47 which opens when the working pressure of power steering apparatus PS (pressure within pressure chamber 34) is greater than a predetermined pressure, thus discharging pressurized fluid to tank T.

Next, operation of the embodiment is described. At stopping of the pump, the working pressure does not act on spool 31 of control valve 29, so that spool 31 is at a standstill with the front end abutting on the inner surface of plug 48 by a biasing force of coil spring 37 as shown in FIG. 1.

Then, with starting of the internal combustion engine, vane rotor 7 is rotated by driving shaft 16 with increase in the engine speed, obtaining increase in the pump speed. In the low rotation area of the pump, the pressure difference is small between the upstream and downstream sides of metering orifice 28, so that spool 31 is maintained in the standstill state that the front end abuts on the inner surface of plug 48 by a biasing force of coil spring 37.

In this state, referring to FIG. 4, valve element 42 is located to open communication passage 38, whereas second land 45 is located to shut off fluid communication with high-pressure chamber 33. Thus, low-pressure (atmospheric-pressure) working fluid in tank T is introduced into first fluid-pressure chamber 12 through low-pressure passage 35, low-pressure chamber 36 of control valve 29, communication passage 38, and passage hole 39. Likewise, low-pressure working fluid in tank T is introduced into second fluid-pressure chamber 13 through suction passage 23 and the like.

Therefore, referring to FIG. 1, by a biasing force of compression coil spring 14, cam ring 6 is held in the position to allow pump chambers 21 to provide a maximum volume.

As the pump speed increases with increase in the engine speed, the discharge out of pump chambers 21 becomes great gradually to enlarge the pressure difference between the upstream and downstream sides of metering orifice 28. When the pressure difference is greater than a predetermined value, spool 31 slides gradually to pressure chamber 34 against a biasing force of coil spring 37 as shown in FIGS. 3 and 5.

At this stage, first recessed groove 43 is located to partly face open end 38*a* of communication passage 38, whereas second recessed groove 44 is also located to partly face open end 38*a* with second land 45 positioned roughly in the center of open end 38*a*. Therefore, the hydraulic pressure within low-pressure chamber 36 and that within high-pressure chamber 33 exit in communication passage 38, and medium-pressure pressurized fluid is supplied therethrough. That is, low-pressure and high-pressure working fluids are gradually introduced into communication passage 38 through first and second recessed grooves 43, 44.

When the pump speed increases to raise the pump discharge pressure, spool 31 slides to pressure chamber 34 as shown in FIG. 6, so that second recessed groove 44 of valve element 42 moves to open end 38*a* of communication passage 38, enlarging the opening area of high-pressure chamber 33.

At this stage, first recessed groove 43 is held to partly face open end 38*a* of communication passage 38. Therefore, pressurized fluid of low-pressure chamber 36 and that of high-pressure chamber 33 still exist in communication passage 38, and the pressure therein is maintained at medium pressure.

This allows restraint of introduction of pressurized fluid having abruptly increased pressure into first fluid-pressure chamber 12, leading to restrained occurrence of abrupt pressure change. Thus, oscillation of cam ring 6 in the swing direction can be prevented from occurring, resulting in stabilized pump discharge and restrained occurrence of noises.

Spool 31 is balanced in such a predetermined position, which is maintained continuously. Thus, with pressurized fluid introduced into first fluid-pressure chamber 12, cam ring 6 is held in the right swing position as viewed in FIG. 3 by the pressure difference between first and second fluid-pressure chambers 12, 13 and a biasing force of compression coil spring 14. Also, pump chambers 21 are balanced in the position to provide a minimum pump discharge.

Then, when pump speed decreases, the pressure difference between both sides of spool 31 becomes smaller to gradually slide spool 31 to the left original position as viewed in FIG. 1. However, an abrupt drop does not occur in the pressure within communication passage 38, i.e. first fluid-pressure chamber 12 through first and second recessed grooves 43, 44, achieving prevention of oscillation of cam ring 6 from occurring.

Further, stepped inner edge 43*a* on the side of second land 45 is shaped roughly like a smooth circular arc, thus allowing smooth supply of pressurized fluid of low-pressure chamber 36 to communication passage 38.

Still further, the inventive structure includes only minute recessed grooves 43, 44 formed in valve element 42. Their formation requires simple and easy working, resulting in not only a reduction in working cost, but also enhancement in forming accuracy of recessed grooves 43, 44.

Furthermore, second recessed groove 44 is shaped in a taper way, allowing achievement of further smooth communication between low-pressure chamber 36 and high-pressure chamber 33.

Further, recessed grooves 43, 44 are formed on both axial sides of valve element 42, allowing not only further enhancement in smooth communication between low-pressure chamber 36 and high-pressure chamber 33, but also sure shutoff of fluid communication between communication passage 38 and high-pressure chamber 33 during pump low rotation by second land 45 arranged between recessed grooves 43, 44.

Having described the present invention in connection with the illustrative embodiment, it is noted that the present invention is not limited thereto, and various changes and modifications can be made without departing from the scope of the present invention.

By way of example, a recessed groove may be formed in valve element 42 on the side of low-pressure chamber 36 only. This alternative allows a reduction in working cost as compared with forming of two recessed grooves. Moreover, immediately after valve element 42 carries out switching from low-pressure chamber 36 to high-pressure chamber 33, the opening area on the side of high-pressure chamber 33 increases, while the opening area on the side of low-pressure chamber 36 includes small opening area of the recessed groove only, allowing full prevention of pressurized fluid which has flowed from high-pressure chamber 33 into communication passage 38 from flowing into low-pressure chamber 36.

Optionally, the recessed groove may be formed stepwise. This alternative allows not only stepwise communication between low-pressure chamber 36 and high-pressure chamber 33, but also control of the flow rate at a constant value in any slide position of spool 31.

As described above, according to the present invention, when pump rotation passes from low to high rotation to slide the spool of the control valve from the low-pressure chamber to the high-pressure chamber, the communication device carries out gradual and smooth switching therebetween for fluid communication with the communication passage, maintaining the pressure within the communication passage at a medium pressure. Thus, occurrence of abrupt pressure change is restrained in the first fluid-pressure chamber. This allows prevention of oscillation of the cam ring in the swing direction from occurring, resulting in stabilized pump discharge.

Further, according to the present invention, the communication device comprises at least one recessed groove formed in the valve element of the spool. Its formation requires simple and easy working, resulting in not only a reduction in working cost, but also enhancement in forming accuracy of the recessed groove.

Still further, according to the present invention, the at least one recessed groove are formed in the valve element of the spool on both sides thereof, wherein the spool comprises a land between the at least one recessed groove, allowing not only further enhancement in smooth communication between the low-pressure and high-pressure chambers, but also sure shutoff of fluid communication between the communication passage and the high-pressure chamber during pump low rotation by the land.

Furthermore, according to the present invention, wherein the at least one recessed groove is arranged on the side of the low-pressure chamber of the control valve only. This allows a reduction in working cost as compared with forming of two recessed grooves. Moreover, immediately after the spool carries out switching from the low-pressure chamber to the high-pressure chamber, the opening area on the side of the high-pressure chamber increases, while the opening area on the side of the low-pressure chamber includes small opening area of the recessed groove only, allowing full prevention of fluid which has flowed from the high-pressure chamber into the communication passage from flowing into the low-pressure chamber.

Further, according to the present invention, the at least one recessed groove is shaped in a taper way, allowing achievement of further smooth communication between the low-pressure and high-pressure chambers.

Furthermore, according to the present invention, the at least one recessed groove is shaped stepwise, allowing not only stepwise communication between the low-pressure and high-pressure chambers, but also control of the flow rate at a constant value in any slide position of the spool.

The entire teachings of Japanese Patent Application P2003-279866 field Jul. 25, 2003 are hereby incorporated by reference.

What is claimed is:

1. A variable displacement pump, comprising:

a housing;

a cam ring arranged in the housing, the cam ring being swingable in the housing;

a seal member provided in a chamber formed between the housing and the cam ring, the seal member dividing the chamber into two portions that defines first and second fluid-pressure chambers;

a rotor rotating within the cam ring and formed with slots, the rotor having an axis offset with respect to an axis of the cam ring;

a plurality of vanes inserted retractably into the slots;

a biasing device arranged in the second fluid-pressure chamber, the biasing device biasing the cam ring to the first fluid-pressure chamber in the direction that increases volumes of pump chambers defined between the cam ring, the rotor, and the vanes;

an orifice provided to a discharge passage, the discharge passage supplying to a hydraulic device a fluid discharged from a discharge port;

a control valve operated by a pressure difference between upstream and downstream sides of the orifice, the control valve comprising a spool slidably arranged in a valve hole, the control valve controlling, in accordance with a slide position of the spool, a pressure of the first fluid-pressure chamber to oscillate the cam ring for variable control of a flow rate of the fluid, the control valve being formed with a high-pressure chamber for introducing therein a high-pressure fluid on the upstream side of the orifice, a pressure chamber for introducing therein a pressure fluid on the downstream side of the orifice, a low-pressure chamber arranged between the high-pressure and pressure chambers for introducing therein a low-pressure fluid, and a communication passage for providing fluid communication between one of the high-pressure and low-pressure chambers and the first fluid-pressure chamber; and a communication device which provides fluid communication between the low-pressure and high-pressure chambers through the communication passage when the spool carries out selective switching between the high-pressure and low-pressure chambers to supply the fluid to the communication passage, wherein the second fluid-pressure chamber introduces therein a low-pressure fluid at least under a condition that the spool of the control valve is maximally displaced so as to provide fluid communication between the low-pressure chamber and the first fluid-pressure chamber, wherein the communication device comprises a first recessed groove formed in one end of a valve element of the spool and a second recessed groove formed in the other end of the valve element, wherein a length of the first recessed groove in an axial direction of the valve element is longer than a length of the second recessed groove in the axial direction of the valve element, the first recessed groove being on a side of the low-pressure chamber of the control valve, and the second recessed groove being on a side of the high-pressure chamber of the control valve, wherein the first recessed groove is located to partly face an open end of the communication passage when the second recessed groove begins to open.

2. The variable displacement pump as claimed in claim 1, wherein the first and second recessed grooves are formed in respective outer-peripheral surfaces of the valve element of the spool.

3. The variable displacement pump as claimed in claim 2, wherein the spool comprises a land between the first and second recessed grooves.

4. The variable displacement pump as claimed in claim 2, wherein at least one of the first and second recessed grooves is shaped in a taper way to be larger to the side of one of the high-pressure and low-pressure chambers of the control valve.

5. The variable displacement pump as claimed in claim 2, wherein at least one of the first and second recessed grooves is shaped stepwise to be larger to the side of one of the high-pressure and low-pressure chambers of the control valve.

6. The variable displacement pump as claimed in claim 1, wherein the communication device has a transitional state in which the first and second recessed grooves communicate with the communication passage at a time while the spool carries out the selective switching.

7. The variable displacement pump as claimed in claim 6, wherein the low-pressure fluid introduced in the second fluid-pressure chamber is supplied from a fluid tank without pressurizing.

8. A variable displacement pump, comprising:

a housing;

a cam ring arranged in the housing, the cam ring being swingable in the housing;

a seal member provided in a chamber formed between the housing and the cam ring, the seal member dividing the chamber into two portions that defines first and second fluid-pressure chambers;

a rotor rotating within the cam ring and formed with slots, the rotor having an axis offset with respect to an axis of the cam ring;

a plurality of vanes inserted retractably into the slots;

first means, arranged in the second fluid-pressure chamber, for biasing the cam ring to the first fluid-pressure chamber in the direction that increases volumes of pump chambers defined between the cam ring, the rotor, and the vanes;

an orifice provided to a discharge passage, the discharge passage supplying to a hydraulic device a fluid discharged from a discharge port;

a control valve operated by a pressure difference between upstream and downstream sides of the orifice, the control valve comprising a spool slidably arranged in a valve hole, the control valve controlling, in accordance with a slide position of the spool, a pressure of the first fluid-pressure chamber to oscillate the cam ring for variable control of a flow rate of the fluid, the control valve being formed with a high-pressure chamber for introducing therein a high-pressure fluid on the upstream side of the orifice, a pressure chamber for introducing therein a pressure fluid on the downstream side of the orifice, a low-pressure chamber arranged between the high-pressure and pressure chambers for introducing therein a low-pressure fluid, and a communication passage for providing fluid communication between one of the high-pressure and low-pressure chambers and the first fluid-pressure chamber; and second means for providing fluid communication between the low-pressure and high-pressure chambers through the communication passage of the control valve when the spool carries out selective switching between the high-pressure and low-pressure chambers to supply the fluid to the communication passage, wherein the second fluid-pressure chamber introduces therein a low-pressure fluid at least under a condition that the spool of the control valve is maximally displaced so as to provide fluid communication between the low-pressure chamber and the first fluid-pressure chamber, wherein the second means for providing fluid communication comprises a first recessed groove formed in one end of a valve element of the spool and a second recessed groove formed in the other end of the valve element, wherein a length of the first recessed groove in an axial direction of the valve element is longer than a length of the second recessed groove in the axial direction of the valve element, the first recessed groove being on a side of the low-pressure chamber of the control valve, and the second recessed groove being on a side of the high-pressure chamber of the control valve, wherein the first recessed groove is located to partly face an open end of the communication passage when the second recessed groove begins to open.

9. The variable displacement pump as claimed in claim 8, wherein the second means for providing fluid communication has a transitional state in which the first and second recessed grooves communicate with the communication passage at a time while the spool carries out the selective switching.

10. A variable displacement pump, comprising:

a housing;

a cam ring arranged in the housing, the cam ring being swingable in the housing;

a seal member provided in a chamber formed between the housing and the cam ring, the seal member dividing the chamber into two portions that defines first and second fluid-pressure chambers, the second fluid-pressure chamber constantly introducing therein a low-pressure fluid;

a rotor rotating within the cam ring and formed with slots, the rotor having an axis offset with respect to an axis of the cam ring;

a plurality of vanes inserted retractably into the slots;

a biasing device arranged in the second fluid-pressure chamber, the biasing device biasing the cam ring to the first fluid-pressure chamber in the direction that increases volumes of pump chambers defined between the cam ring, the rotor, and the vanes;

an orifice provided to a discharge passage, the discharge passage supplying to a hydraulic device a fluid discharged from a discharge port;

a control valve operated by a pressure difference between upstream and downstream sides of the orifice, the control valve comprising a spool slidably arranged in a valve hole, the control valve controlling, in accordance with a slide position of the spool, a pressure of the first fluid-pressure chamber to oscillate the cam ring for variable control of a flow rate of the fluid, the control valve being formed with a high-pressure chamber for introducing therein a high-pressure fluid on the upstream side of the orifice, a pressure chamber for introducing therein a pressure fluid on the downstream side of the orifice, a low-pressure chamber arranged between the high-pressure pressure and pressure chambers for introducing therein a low-pressure fluid, and a communication passage for providing fluid communication between one of the high-pressure and low-pressure chambers and the first fluid-pressure chamber; and a communication device which provides fluid communication between the low-pressure and high-pressure chambers through the communication passage when the spool carries out selective switching between the high-pressure and low-pressure chambers to supply the fluid to the communication passage, wherein the communication device comprises a first recessed groove formed in one end of a valve element of the spool and a second recessed groove formed in the other end of the valve element, wherein a length of the first recessed groove in an axial direction of the valve element is longer than a length of the second recessed groove in the axial direction of the valve element, the first recessed groove being on the side of a low-pressure chamber of the control valve, and the second recessed groove being on a side of the high-pressure chamber of the control valve, wherein the first recessed groove is located to partly face an open end of the communication passage when the second recessed groove begins to open.

11. The variable displacement pump as claimed in claim 10, wherein the communication device has a transitional state in which the first and second recessed grooves communicate with the communication passage at a time while the spool carries out the selective switching.

* * * * *